US008021721B2

(12) United States Patent
Griffo

(10) Patent No.: US 8,021,721 B2
(45) Date of Patent: Sep. 20, 2011

(54) COMPOSITE COATING WITH NANOPARTICLES FOR IMPROVED WEAR AND LUBRICITY IN DOWN HOLE TOOLS

(75) Inventor: Anthony Griffo, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 708 days.

(21) Appl. No.: 11/743,051

(22) Filed: May 1, 2007

(65) Prior Publication Data

US 2008/0127475 A1 Jun. 5, 2008

Related U.S. Application Data

(60) Provisional application No. 60/796,483, filed on May 1, 2006.

(51) Int. Cl.
*B05D 1/18* (2006.01)
*B05D 1/24* (2006.01)

(52) U.S. Cl. ..... 427/430.1; 427/436; 427/437; 427/438; 427/443.1; 427/443.2; 205/109; 205/110; 977/890; 977/892

(58) Field of Classification Search ..... 205/110; 427/430.1

See application file for complete search history.

(56) References Cited

U.S. PATENT DOCUMENTS

| | | | | |
|---|---|---|---|---|
| 5,190,796 | A | 3/1993 | Iacovangelo | |
| 6,068,070 | A | 5/2000 | Scott | |
| 6,105,694 | A | 8/2000 | Scott | |
| 6,156,390 | A | 12/2000 | Henry et al. | |
| 6,371,225 | B1 | 4/2002 | Overstreet et al. | |
| 6,450,271 | B1 | 9/2002 | Tibbitts | |
| 6,852,414 | B1 * | 2/2005 | Frushour | 428/408 |
| 2003/0228249 | A1 * | 12/2003 | Fujimura et al. | 423/446 |
| 2005/0014010 | A1 * | 1/2005 | Dumm et al. | 428/472 |
| 2005/0230150 | A1 * | 10/2005 | Oldham et al. | 175/57 |
| 2007/0169419 | A1 * | 7/2007 | Davis et al. | 51/293 |

FOREIGN PATENT DOCUMENTS

| | | | |
|---|---|---|---|
| JP | 04-333599 | * | 11/1992 |
| JP | 05-106124 | * | 4/1993 |
| JP | 2002-265968 | * | 9/2002 |
| WO | 2005/002742 | * | 1/2005 |
| WO | 2006/099068 | * | 9/2006 |

OTHER PUBLICATIONS

A. Aleksenskii, et al "The structure of diamond nanoclusters", Phys. Solid State 41 (4), Apr. 1999, pp. 668-671.*

English translation of Japan 04-333599, first published in Japanese Nov. 1992.*

A. L. Vereschagin, et al. "Properties of Ultrafine Diamond Clusters from Detonation Synthesis"—Diamond and Related Materials (1993) 160-162.

* cited by examiner

*Primary Examiner* — Katherine A Bareford

(74) *Attorney, Agent, or Firm* — Osha Liang LLP

(57) ABSTRACT

A method of modifying a bottomhole assembly that includes metal plating at least a portion of a bottomhole assembly, wherein the metal-plating comprises superabrasive nanoparticles is disclosed.

9 Claims, 3 Drawing Sheets

COMPOSITE COATING WITH NANOPARTICLES FOR IMPROVED WEAR AND LUBRICITY IN DOWN HOLE TOOLS

CROSS-REFERENCE TO RELATED APPLICATIONS

This application claims priority, pursuant to 35 U.S.C. §119(e), to U.S. Provisional Patent Application Ser. No. 60/796,483, filed on May 1, 2006, which is herein incorporated by reference in its entirety.

BACKGROUND OF INVENTION

1. Field of the Invention

The present disclosure relates generally to modifying components of a bottomhole assembly used in oil drilling with metal-plate coatings. In particular, the disclosure relates to metal-plate coatings which comprise nanoparticles.

2. Background Art

A variety of techniques have been developed for coating machined parts to protect against oxidation, heat, wear, and corrosion. Methods for depositing such coatings include chemical and pressure vapor deposition (CVD and PVD respectively), plasma ion beam deposition, electrolytic and electroless plating, and flame spraying. The choice of which method to use for a particular application may depend on the required tolerances of the machined parts, the temperatures that the parts can withstand, the chemical composition of the parts, the desired effect of the coating, and other factors such as the size and shape of the surface to be coated. An area of particular importance in which these techniques may be applied is oil exploration, where drilling conditions can subject the various parts of the bottomhole assembly (BHA) to high temperatures, pressures, and abrasive/erosive wear.

Rotary drill bits are typically employed for drilling wells in subterranean formations. Another bit type that may be used in drilling wells are percussive bits. One type of rotary drill bit that is used is commonly referred to as a roller cone bit. Roller cone bits typically comprise a bit body having an externally threaded connection at one end, and at least one roller cone (often two or three cones are used) attached to the other end of the bit and able to rotate with respect to the bit body. Attached to the cones of the bit are a plurality of cutting elements typically arranged in rows about the surface of the cones. The cutting elements are typically tungsten carbide inserts, polycrystalline diamond compacts, or milled steel teeth.

Rotary drill bits with no moving elements on them are typically referred to as "drag" bits. Drag bits are often used to drill very hard or abrasive formations. Drag bits include those having cutting elements attached to the bit body, such as polycrystalline diamond compact insert bits, and those including abrasive material, such as diamond, impregnated into the surface of the material which forms the bit body. The latter bits are commonly referred to as "impreg" bits.

Drill bits may be used in hard, tough formations and high pressures and temperatures are frequently encountered. The total useful life of a drill bit is typically on the order of 20 to 200 hours for bits in sizes of about 6 to 28 inch diameter at depths of about 5,000 to 20,000 feet. Useful lifetimes of about 65 to 150 hours are typical. When a drill bit wears out or fails as a bore hole is being drilled, it is necessary to withdraw the drill string to replace the bit which is a very expensive and time consuming process. Prolonging the lives of drill bits minimizes the lost time in "round tripping" the drill string for replacing bits.

Replacement of a drill bit can be required for a number of reasons, including wearing out or breakage of the structure contacting the rock formation. One reason for replacing the drill bits includes failure or wear of the journal bearings on which the roller cones are mounted. The journal bearings are subjected to very high drilling loads, high hydrostatic pressures in the hole being drilled, and high temperatures due to drilling, as well as elevated temperatures in the formation being drilled. The operating temperature of the grease in the drill bit can exceed 300° F. Considerable work has been conducted over the years to produce bearing structures and employ materials that minimize wear and failure of such bearings.

Where roller cone bits are employed, the area around the seal between the journal and the roller cone can be subject to wear. This occurs because abrasives tend to get lodged in the elastomeric seal where they continually grate at the journal base and/or the roller cone.

Additionally, the cutting elements and other outer portions of any bit type are subject to constant wear with continual direct contact with hard rock formations and abrasive sands in the drilling fluids. Such wear decreases the cutting effectiveness and requires eventual bit replacement.

FIG. 1 shows one example of a conventional drilling system for drilling an earth formation. The drilling system includes a drilling rig 10 used to turn a drilling tool assembly 12 that extends downward into a wellbore 14. The drilling tool assembly 12 includes a drilling string 16, and a bottomhole assembly (BHA) 18, which is attached to the distal end of the drill string 16. The "distal end" of the drill string is the end furthest from the drilling rig.

The drill string 16 includes several joints of drill pipe 16*a* connected end to end through tool joints 16*b*. The drill string 16 is used to transmit drilling fluid (through its hollow core) and to transmit rotational power from the drill rig 10 to the BHA 18. In some cases the drill string 16 further includes additional components such as subs, pup joints, etc.

The BHA 18 includes at least a drill bit 20. Typical BHA's may also include additional components attached between the drill string 16 and the drill bit 20. Examples of additional BHA components include drill collars, stabilizers, measurement-while-drilling (MWD) tools, logging-while-drilling (LWD) tools, subs, hole enlargement devices (e.g., hole openers and reamers), jars, accelerators, thrusters, downhole motors, and rotary steerable systems.

In general, drilling tool assemblies 12 may include other drilling components and accessories, such as special valves, such as kelly cocks, blowout preventers, and safety valves. Additional components included in a drilling tool assembly 12 may be considered a part of the drill string 16 or a part of the BHA 18 depending on their locations in the drilling tool assembly 12. The drill bit 20 in the BHA 18 may be any type of drill bit suitable for drilling earth formation.

In particular, the moving parts of the mud motor and portions of the drill bit experience abrasive stresses from the drilling environment. A number of prior art methods to improve the resistance of the BHA to damage have been attempted.

As one example, U.S. Pat. No. 6,371,225 discloses the use of transition metal carbide and nitrite coatings for the cutting elements (or inserts) in a rotary rock bit assembly to improve surface finish. Prior to surface finishing techniques, the hard metal coating was deposited by chemical vapor deposition (CVD) onto a tungsten carbide insert, which is tolerant of the temperatures used in the CVD technique.

In another example, U.S. Pat. No. 6,068,070 discloses the use of CVD diamond on bearing surfaces where the journal and roller cone cutter surfaces meet in a rotary drill bit. Because the temperatures of the CVD process may range from 700 to 2000° C., the bearing surfaces could not be directly coated with a CVD diamond film. A CVD diamond film was formed on a substrate, removed, and attached to the bearing surface via brazing. The brazing temperatures range from 750 to 1200° C., which precludes the use of certain materials for the base material of the journal and roller cone pieces. U.S. Pat. No. 6,105,694 discloses a similar strategy for coating cutting elements of the roller cone bit.

U.S. Pat. No. 6,450,271 discloses coatings for low adhesion to the outer portion of drill bits using plating materials, such as nickel, chromium, and copper, in conjunction with TEFLON®-like materials. Included in the methods of coating the bit are electroless plating, electrochemical plating, ion plating, and flame spraying techniques. The '271 patent also discloses the use of CVD techniques for incorporation of superabrasive materials such as diamond, polycrystalline diamond, diamond-like carbon, nanocrystalline carbon, and other carbon based coatings.

CVD and PVD techniques are typically carried out at very high temperature and are therefore not generally applicable to all BHA components that might benefit from a wear resistant coating. Accordingly, there exists a need for lower temperature methods of applying protective coatings to BHA components.

SUMMARY OF INVENTION

In one aspect, embodiments disclosed herein relate to a method of modifying a bottomhole assembly that includes metal plating at least a portion of a bottomhole assembly, wherein the metal-plating comprises superabrasive nanoparticles.

In another aspect, embodiments disclosed herein relate to a bottomhole assembly that includes a drill bit and a downhole motor, wherein at least a portion of at least one of the drill bit and the downhole motor are coated with a metal-based coating, and wherein the metal-based coating comprises superabrasive nanoparticles.

Other aspects and advantages of the invention will be apparent from the following description and the appended claims.

DETAILED DESCRIPTION

Figure 1:
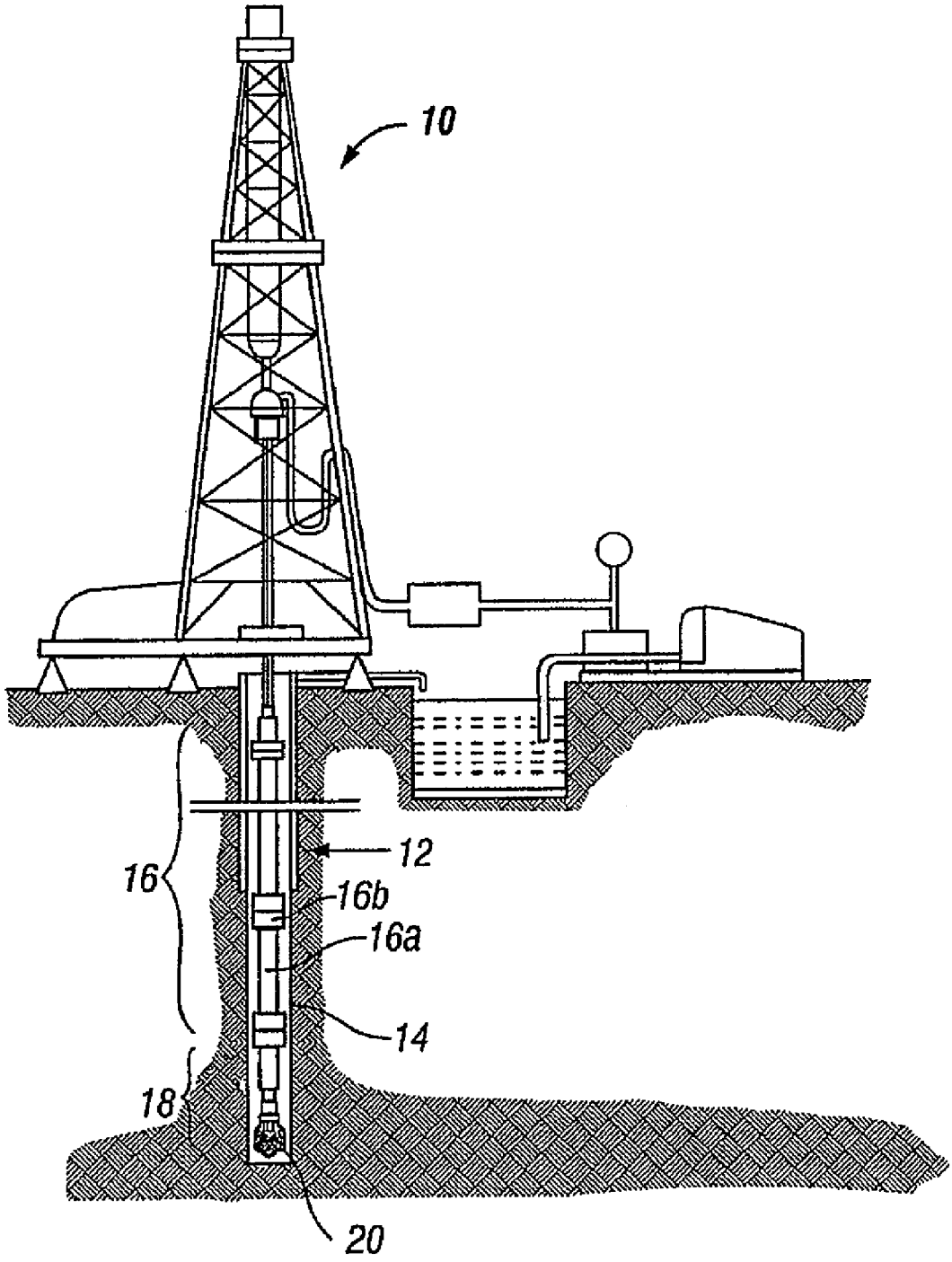
FIG. 1 (Prior Art)
FIG. 1 illustrates a typical bottomhole assembly.

In one aspect, embodiments disclosed herein are generally related to coating one or more parts of a bottomhole assembly (BHA) used in subterranean drilling. More specifically, embodiments disclosed herein relate to coating one or more parts of the BHA with a metal-plating co-deposited with superabrasive nanoparticles ("the metal-plating"). In a particular embodiment, the metal-plating is introduced onto portions of the BHA via an electroless plating or electrolytic plating process.

Metal-Plating

In one embodiment, at least one BHA component may be coated via metal-plating techniques. In a particular embodiment, at least one BHA component may be coated via electroless or electrolytic metal-plating. Methods of metal-plating superabrasive particles are disclosed, for example, in U.S. Patent Publication 2005/0014010, U.S. Pat. Nos. 5,190,796 and 6,156,390, which are herein incorporated by reference.

Electroless plating may use a redox reaction to deposit metal on an object without the passage of an electric current. In one embodiment, a bath solution containing a reducing agent supplies the electrons for the deposition reaction. These baths may comprise a variety of chelating and/or complexing agents that hold the metals in solution. Chelating agents may comprise ethylenediaminetetraacetic acid (EDTA), citrates, oxalates, cyanides, and 1,2 diaminocyclohexanetetraacetic acid (DCTA). The metals plated in this process may be nickel, copper, cobalt, and gold most commonly. Deposition rates may be controlled by the amount of reducing agent present and the type of chelating agent used.

In electrolytic plating (or electroplating), the anode and cathode in an electroplating cell are connected to an external supply of direct current, a battery, or more commonly a rectifier. The anode is connected to the positive terminal of the supply, and the cathode (article to be "plated") is connected to the negative terminal. When the external power supply is switched on, the metal at the anode is oxidized from the 0 valence state to form cations with a positive charge. These cations associate with the anions in the solution. The cations are reduced at the cathode to deposit the zero valent metal.

In one embodiment of the present disclosure, the solution for either electroless or electrolytic plating may also comprise a superabrasive nanoparticle for co-deposition.

Base Metal Coating

In one embodiment of the present disclosure the metal-plating comprises a base metal that may include at least one of chromium, nickel, copper, cobalt, iron, silver, gold, molybdenum, and/or mixtures thereof. One of ordinary skill in the art would appreciate that the selection of a particular metal-plate will depend on the physical and chemical properties of the surface to be coated, the desired properties of the coated article, and the conditions to which that the article will be subjected. In one embodiment, a chrome-plating may be used to coat the BHA components. In another embodiment, a nickel-plating may be used to coat the BHA components. For example, a chrome plating solution may comprise chromic anhydride, potassium silicon fluoride, barium sulfate, sulfuric acid, and superabrasive nanoparticles and a nickel-plating solution may comprise nickel (II) sulfate, nickel (II) chloride, boric acid, and superabrasive nanoparticles. Analogous compositions may be generated to plate copper, cobalt, iron, silver, gold, molybdenum and other transition metals. While reference may be made to specific plating solutions, no limitation is intended by such reference. Rather, one of ordinary skill in the art would recognize that the plating solutions may be varied.

In one embodiment, the thickness of the metal-plate coating may range in thickness from about 2 to 250 microns. In another embodiment, the metal-plate coating may range in thickness from about 5 to 15 microns. In yet another embodiment, the metal-plate coating may range in thickness from about 5 to 100 microns.

Superabrasive Nanoparticles

In one embodiment of the present disclosure, the metal-plate coating also comprises superabrasive nanoparticles. In one embodiment, these nanoparticles may range in size from about 0.1 to 100 nanometers. In other embodiments, the nanoparticles may range from 0.5 to 50, 1 to 10, or other combinations of ranges within this broad range. In another embodiment the particles may range from about 0.5 to 10 nm.

In one embodiment, the superabrasive nanoparticles may comprise at least one selected from diamond, cubic boron nitride, boron carbide, silicon carbide, aluminum oxide, tungsten carbide, polycrystalline diamond, and diamond-like carbon, In another embodiment, the metal-plate coating may include a lubricious solid, including, at least one of amorphous carbon, graphite, molybdenum sulfide, hBN, and polymers. An example of polymers that may be coated as disclosed herein include Metalife Polymers, which are commercially available from Metalife Industries, Inc. (Reno, Pa.). In a particular embodiment, the metal-plate coating may include a lubricious solid ranging in size from about 0.5 to 1000 nanometers. In another embodiment, the metal-plate coating may include a lubricious solid ranging in size from about In a particular embodiment, the superabrasive nanoparticle may comprise diamond (or nanodiamond). One suitable method for generating nanodiamond may include, for example, a detonation process as described in *Diamond and Related Materials* (1993, 160-2), which is incorporated by reference in its entirety, although nanodiamond produced by other methods may be used. Those having ordinary skill in the art will appreciate how to form nanodiamond particles. In some embodiments, the nanodiamond particles may be clustered in loose agglomerates ranging in size from nanoscale to larger than nanoscale.

Briefly, in order to produce nanodiamond by detonation, detonation of mixed high explosives in the presence of ultradispersed carbon condensate forms ultradispersive diamond-graphite powder (also known as diamond blend—DB), which is a black powder containing 40-60 wt. % of pure diamond. Chemical purification of DB generates pure nanodiamond (also known as Ultradispersive detonational diamond—UDD), a grey powder containing up to 99.5 wt. % of pure diamond. Suitable reaction conditions may involve temperatures at several thousand degrees Celsius under tens of gigaPascal pressure for several tenths of a microsecond. Purification may be accomplished, for example, by reacting the substance produced with an oxidizing mixture of sulphuric and nitric acids at about 250° C.

The ultrafine particles generated by the detonation process may comprise a nanodiamond core, a graphite inner coating around the core, and an amorphous carbon outer coating about the graphite. The nanodiamond core may comprise up to 1.0% hydrogen, up to 2.5% nitrogen, and up to 10% oxygen. In one embodiment, the nanodiamond core may comprise at least 90% or more of the weight of the nanodiamond particle comprising the core, graphite, and amorphous carbon layers.

In one embodiment the nanodiamond with the graphite and amorphous carbon shells may be used in the co-deposition metal-plating process. In another embodiment, the graphite and amorphous carbon layers may be removed by chemical etching. The core nanodiamond may then be used in the co-deposition metal-plating process.

In one embodiment, these nanoparticles may be co-deposited with the base metal-plating via an electroless or electrolytic process and may be part of the plating solution. Plating solutions containing these nanoparticles may be purchased from commercially available sources such as the XADC-Armoloy® product of Armoloy® of Illinois.

In one embodiment of the present disclosure, the superabrasive nanoparticles may constitute 1 to 50 g/liter of the solution of the metal-plating bath. In another embodiment, the superabrasive nanoparticles may constitute 10-20 g/liter of the solution of the metal-plating bath. In yet another embodiment, the superabrasive nanoparticles may constitute 12-15 g/liter of the solution of the metal-plating bath. Optimum concentrations of superabrasive nanoparticles may produce a random packing and smaller grain size of the electroplated metal crystal. The hardness of the plated metal may be a function of the grain size.

Application to BRA Components

In one embodiment of the present disclosure, at least a portion of a turbine or a mud motor assembly may be coated with the metal-plating. In a particular embodiment, the mud motor bearing surfaces may be coated with the metal-plating. In another embodiment the shafts and rotors of the mud motor may be coated with the metal-plating. In yet another embodiment, other parts of the motor that may be subjected to the abrasive drilling environment or to internal stresses causing wear may be coated with the metal-plating.

Figure 2:
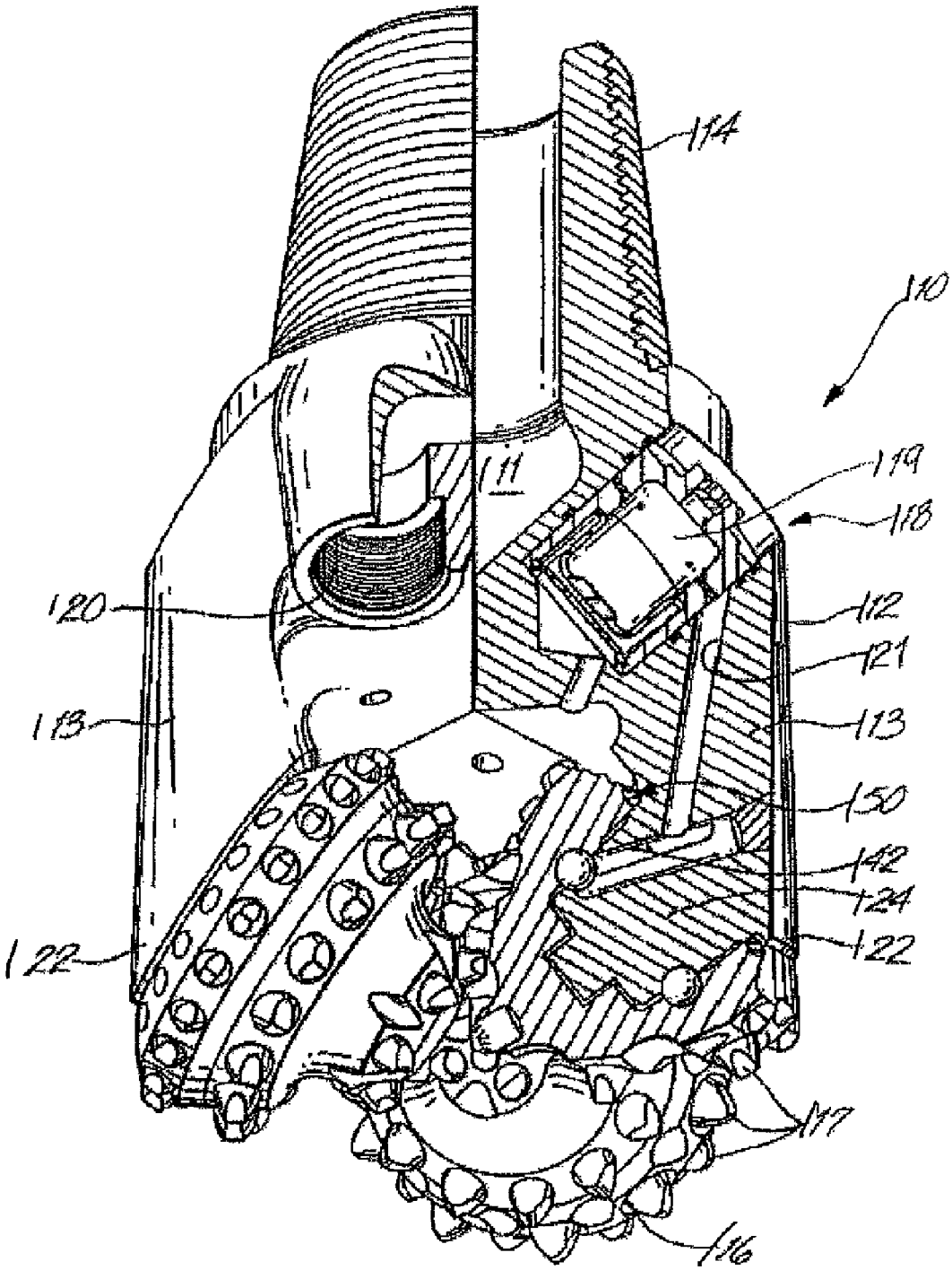
FIG. 2 is a semi-schematic perspective of a rotary drill bit in one embodiment of the present disclosure.
Figure 3:
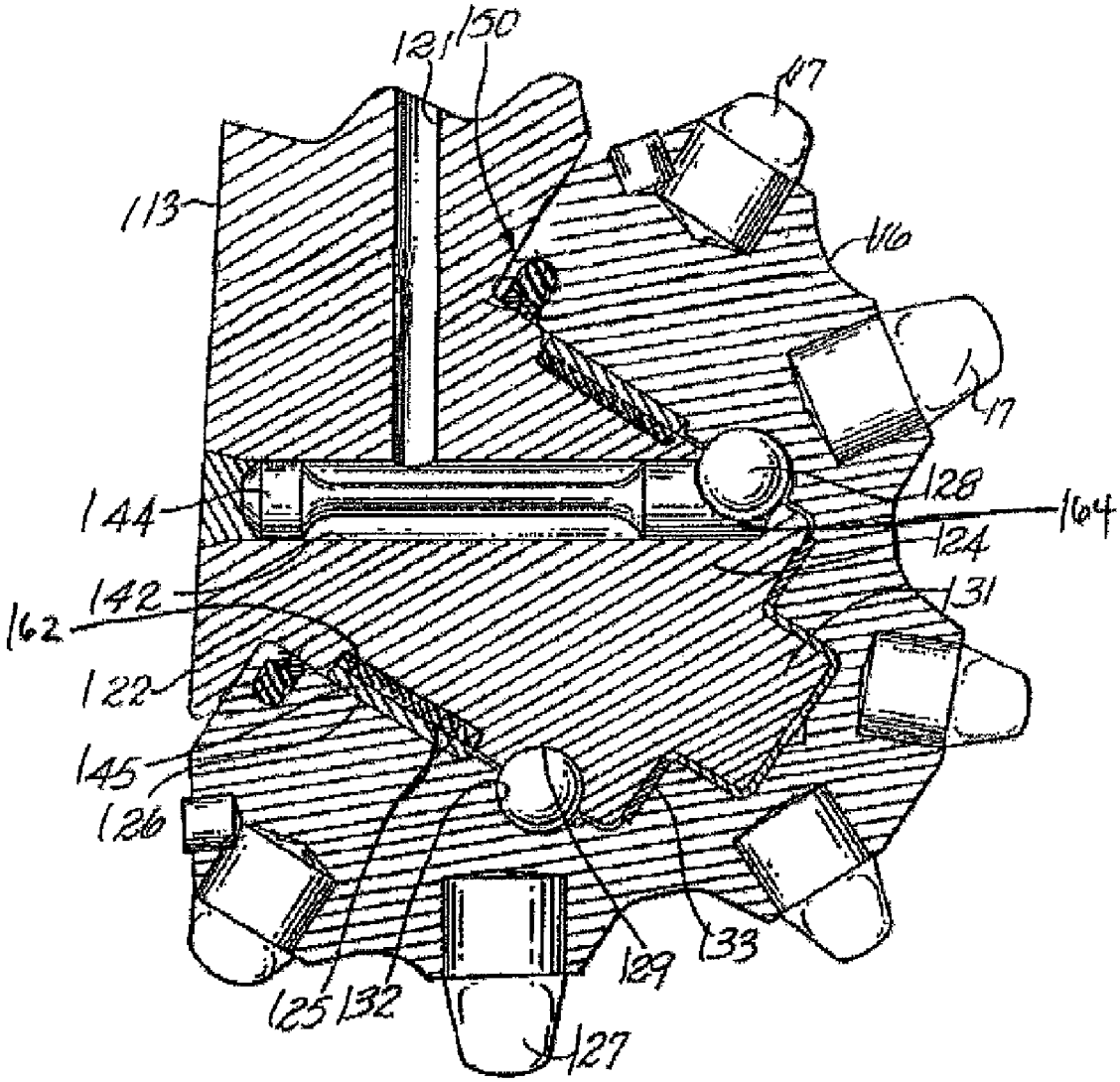
FIG. 3 is a partial cross-section of the drill bit of FIG. 2.

In one embodiment of the present disclosure, various parts of a rotary drill bit assembly may be coated with the metal-plating. Referring now to FIGS. 2 and 3, a sealed bearing rotary cone rock bit, generally designated as 110, consists of bit body 112 forming an upper pin end 114 and a cutter end of roller cones 16 that are supported by legs 113 extending from body 112. The threaded pin end 14 is adapted for assembly onto a drill string (not shown) for drilling oil wells or the like. Each of the legs 113 terminate in a shirttail portion 122. Each of the roller cones 116 typically have a plurality of cutting elements 117 pressed within holes formed in the surfaces of the cones for bearing on the rock formation to be drilled. Nozzles 120 in the bit body 112 introduce drilling mud into the space around the roller cones 116 for cooling and carrying away formation chips drilled by the drill bit. While reference is made to an insert-type bit, the scope of the present invention should not be limited by any particular cutting structure. Embodiments of the present disclosure generally apply to any rock bit (whether roller cone, disc, etc.) that requires lubrication by grease.

Each roller cone 116 is in the form of a hollow, frustoconical steel body having cutting elements 117 pressed into holes on the external surface. For long life, the cutting elements may be tungsten carbide inserts tipped with a polycrystalline diamond layer. Such tungsten carbide inserts provide the drilling action by engaging a subterranean rock formation as the rock bit is rotated. Some types of bits have hardfaced steel teeth milled on the outside of the cone instead of carbide inserts.

Each leg 113 includes a journal 124 extending downwardly and radially inward on the rock bit body. The journal 124 includes a cylindrical bearing surface 125 which may have a flush hardmetal deposit 162 on a lower portion of the journal 124.

The cavity in the cone 116 contains a cylindrical bearing surface 126. A floating bearing 145 may be disposed between the cone and the journal. Alternatively, the cone may include a bearing deposit in a groove in the cone (not shown separately). The floating bearing 145 engages the hardmetal deposit 162 on the leg and provides the main bearing surface for the cone on the bit body. The end surface 133 of the journal 124 carries the principal thrust loads of the cone 116 on the journal 124. Other types of bits, particularly for higher rotational speed applications, may have roller bearings instead of the exemplary journal bearings illustrated herein.

A plurality of bearing balls 128 are fitted into complementary ball races 129, 132 in the cone 116 and on the journal 124. These balls 128 are inserted through a ball passage 142, which extends through the journal 124 between the bearing races and the exterior of the drill bit. A cone 116 is first fitted on the journal 124, and then the bearing balls 128 are inserted through the ball passage 142. The balls 128 carry any thrust loads tending to remove the cone 116 from the journal 124 and thereby retain the cone 116 on the journal 124. The balls 128 are retained in the races by a ball retainer 164 inserted through the ball passage 142 after the balls are in place. A plug 144 is then welded into the end of the ball passage 142 to keep the ball retainer 164 in place.

Contained within bit body 112 is a grease reservoir system generally designated as 118. Lubricant passages 121 and 142 are provided from the reservoir to bearing surfaces 125, 126 formed between a journal bearing 124 and each of the cones 116. Drilling fluid is directed within the hollow pin end 114 of the bit 110 to an interior plenum chamber 111 formed by the bit body 112. The fluid is then directed out of the bit through the one or more nozzles 120.

The bearing surfaces between the journal 124 and cone 116 are lubricated by a lubricant or grease composition. Preferably, the interior of the drill bit is evacuated, and lubricant or grease is introduced through a fill passage 146. The lubricant or grease thus fills the regions adjacent the bearing surfaces plus various passages and a grease reservoir. The grease reservoir comprises a chamber 119 in the bit body 110, which is connected to the ball passage 142 by a lubricant passage 121. Lubricant or grease also fills the portion of the ball passage 142 adjacent the ball retainer. Lubricant or grease is retained in the bearing structure by a resilient seal 150 between the cone 116 and journal 124

Lubricant contained within chamber 119 of the reservoir is directed through lube passage 121 formed within leg 113. A smaller concentric spindle or pilot bearing 131 extends from end 133 of the journal bearing 124 and is retained within a complimentary bearing formed within the cone. A seal generally designated as 150 is positioned within a seal gland formed between the journal 124 and the cone 116. The cavity of seal 150, bounded by the journal 124 on one side and the cone 116 on the other is particularly prone to wear of the metal.

In one embodiment of the present disclosure, at least a portion of at least some of the components of the drill bit assembly described above may be coated with a metal-plating comprising a superabrasive nanoparticle. In a particular embodiment of the present disclosure, at least a portion of at least one of a leg, journal, cone, cutting elements, bit body, bearing surfaces of the journal and cone, and/or the cavity of the seal may be coated with said metal-plating.

In yet another embodiment, other parts of the BHA (FIG. 1) may also be coated with the metal-plating. These may include, but are not limited to drilling tube coils, drill collars, connectors, and check and pressure valve assemblies.

Advantages of the current process may include introduction, under mild conditions, a metal-plated coating that will have enhanced resistance to the abrasives drilling environment. Further, one may protect surfaces that are particularly sensitive and incompatible with conventional coating techniques such as CVD and PVD. Nanodiamond particles incorporated in metal-platings may provide hard, wear resistant metal coatings with low friction and wear. Core nanodiamond in metal-plating baths may increase the microhardness of the electroplated metals by 15-70% in the case of nickel, chromium, copper, and cobalt-phosphorus. Core nanodiamond in metal-plating baths may increase the microhardness of electroless-plated copper by more than 250%.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method of modifying a bottomhole assembly, comprising:

coating at least a portion of a bottomhole assembly with a metal plating;

wherein the metal plating comprises a base metal and clusters of superabrasive nanoparticles;

wherein the superabrasive nanoparticles have a particle size ranging from 0.1 to 100 nanometers; and wherein the superabrasive nanoparticles comprise a diamond core and a non-diamond carbon-based coating on the diamond core;

wherein the carbon-based coating comprises an inner coating of graphite and an outer coating of amorphous carbon.

2. The method of claim 1, wherein coating at least a portion of the bottomhole assembly with a metal plating comprises coating at least a portion of at least one of a drill bit, a motor, and a turbine.

3. The method of claim 2, wherein coating at least a portion of the bottomhole assembly with a metal plating comprises coating at least a portion of a drill a bit, wherein the drill bit may include at least a portion of at least one selected from a leg, a journal, a bearing, a bit body, a cone, and a seal cavity.

4. The method of claim 1, wherein the base metal comprises at least one selected from chromium, nickel, copper, cobalt, iron, silver, gold, molybdenum, and/or mixtures thereof.

5. The method of claim 1, wherein the metal plating has a thickness ranging from about 2 to 250 microns.

6. The method of claim 5, wherein the metal plating has a thickness ranging from about 5 to 15 microns.

7. The method of claim 1, wherein the superabrasive nanoparticles have a particle size ranging from about 0.5 to 50 nm.

8. The method of claim 7, wherein the superabrasive nanoparticles have a particle size ranging from about 1 to 10 nanometers.

9. The method of claim 1, wherein the metal plating further comprises at least one of amorphous carbon, graphite, molybdenum disulfide, hBN, and polymers.

* * * * *